United States Patent [19]

McClure

[11] Patent Number: 4,488,588

[45] Date of Patent: Dec. 18, 1984

[54] CORD LOCK FOR VENETIAN BLIND

[75] Inventor: David K. McClure, Muncy, Pa.

[73] Assignee: Marathon Manufacturing Company, Houston, Tex.

[21] Appl. No.: 460,445

[22] Filed: Jan. 24, 1983

[51] Int. Cl.[3] ..... E06B 9/38

[52] U.S. Cl. ..... 160/178 C

[58] Field of Search ..... 160/166, 168, 172, 173, 160/174, 176, 178 R, 178 C

[56] References Cited

U.S. PATENT DOCUMENTS

| | | | |
|---|---|---|---|
| 2,194,277 | 3/1940 | Feeney | 160/173 |
| 2,391,709 | 12/1945 | Kasan | 160/174 |
| 2,562,781 | 7/1951 | Fox | 160/174 |
| 2,744,572 | 5/1956 | Lorentzen | 160/173 |
| 3,799,236 | 3/1974 | Debs | 160/178 C |
| 3,931,846 | 1/1976 | Zilver | 160/178 C |
| 3,952,789 | 4/1976 | Marotto | 160/178 C |
| 4,180,118 | 12/1979 | Vecchiarelli | 160/178 C |
| 4,245,688 | 1/1981 | Vecchiarelli | 160/178 C |
| 4,250,597 | 2/1981 | Ford et al. | 160/178 C |
| 4,327,797 | 5/1982 | Nakajima et al. | 160/178 C |

*Primary Examiner*—Peter M. Caun

*Attorney, Agent, or Firm*—Robert K. Youtie

[57] ABSTRACT

A cord lock for mounting in the headrail channel of a venetian blind including a hollow structure seated on the bottom wall of the channel and having a lower opening for communication through the channel bottom wall, front and back shoulders externally on the hollow structure engaging upper regions of the headrail channel to retain the hollow structure in position in the channel, a cord guide in the hollow of said structure, and a jamming element movable in the hollow structure upwardly toward and downwardly away from the cord guide for jamming and releasing a lift cord between said guide and jamming element.

6 Claims, 5 Drawing Figures

FIG. 4
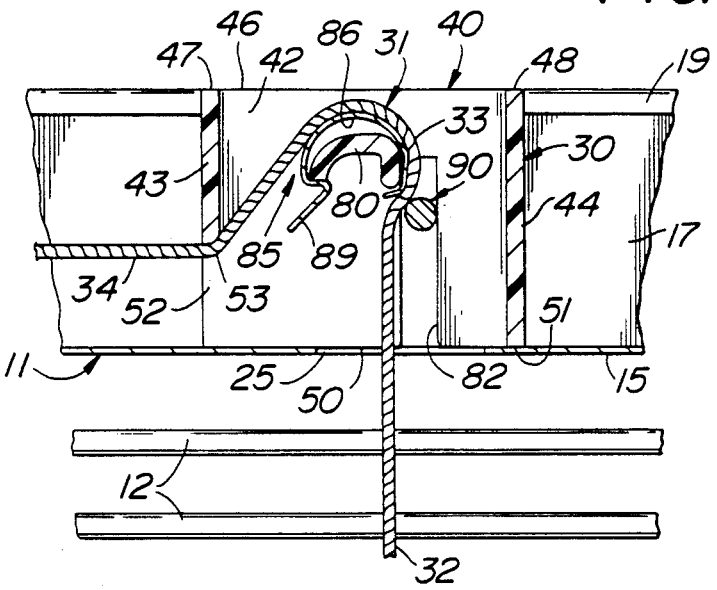
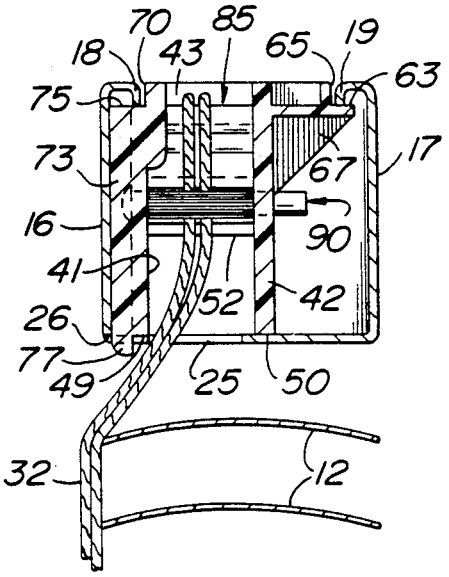
FIG. 5

CORD LOCK FOR VENETIAN BLIND

BACKGROUND OF THE INVENTION

As is well known to those versed in the venetian blind arts, conventional lift cord locks have, in the past, been relatively expensive, being fabricated of several metal parts, the assembled cord lock requiring fastening, as by riveting or other such securement in a headrail channel, and usually requiring an angular relation to the headrail, all of which makes for expensive manufacture of a relatively complex structure, time consuming assembly and relatively high likelihood of malfunction. Applicant is aware of the below listed prior art concerning venetian blind cord locks:

| U.S. Pat. No. | PATENTEE |
|---|---|
| 2,194,277 | Feeney |
| 2,391,709 | Kasan |
| 2,562,781 | Fox |
| 3,931,846 | Zilver |
| 3,952,789 | Marotto |
| 4,180,118 | Vecchiarelli |
| 4,250,597 | Ford et al. |
| 4,327,797 | Nakajima et al. |

SUMMARY OF THE INVENTION

It is an important object of the present invention to provide a highly improved cord lock for the lift cord of a venetian blind which is extremely simple in construction, consisting primarily of a unitary molded plastic part capable of relatively inexpensive manufacture by mass production techniques; which is adapted for instantaneous snap assembly with a headrail without additional fastening elements or operations; is simple in construction and operation for highly reliable operation throughout a long useful life; and which seats square on or perpendicular to a headrail bottom wall for simplified tooling in manufacture and ease of assembly without special tools or equipment.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 4 is a longitudinal sectional elevational view taken generally along the line 4—4 of FIG. 1.

FIG. 5 is a transverse sectional view taken generally along the line 5—5 of FIG. 1.

DESCRIPTION OF THE PREFERRED EMBODIMENT

Figure 1:
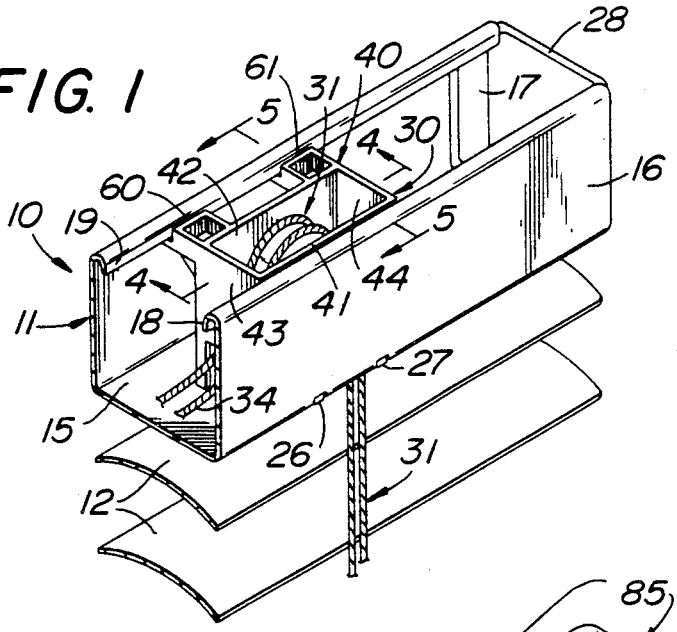
FIG. 1 is a partial top perspective view showing a venetian blind including a cord lock constructed in accordance with the teachings of the present invention.

Referring now more particularly to the drawings, and specifically to FIG. 1 thereof, a venetian blind is there generally designated 10 and includes at its upper end a normally horizontally disposed headrail 11, and below the headrail a plurality of horizontally extending, superposed slats 12. The headrail 11 may be conventional, being defined by a channel including a generally horizontal bottom wall 15, and upstanding from front and rear longitudinal edges of the bottom wall are front and back walls 16 and 17. The channel or headrail 11 may be of generally rectangular cross section, as illustrated, with the bottom wall 15 generally horizontal and the front and back side walls 16 and 17 upstanding vertically and in parallelism with each other, spaced apart by the width or the depth of the bottom wall. The upper longitudinal margins or edges of the front and back channel walls 16 and 17 may be curled, bent or turned inwardly, as at 18 and 19 to define retaining lips, as will appear more fully hereinafter.

The bottom wall 15 of headrail channel 11 may be formed with a through opening, hole or cut-out, as at 25, which may be generally rectangular or other suitable configuration, and may be provided with a pair of cut-out extensions or notches, as at 26 and 27, see FIG. 1, extending generally to the front channel wall 16.

Suitable reinforcing means may be employed to strengthen the headrail channel 11, say wire reinforcement elements 28 extending into opposite ends of the channel and interfitting with the downwardly curled lips 18 and 19 to retain the channel against relative movement of the channel front and back walls 16 and 17 toward or away from each other.

Interiorly of the channel 11, over the cut-out 25, there is mounted a cord lock assembly, generally designated 30, through which extends the lift cord 31. That is, the lift cord 31 extends from a manual actuating portion 32 in front of the slats 12 upwardly through the cut-out 25 into the cord lock 30, there being the cord portion 33 (see FIG. 4), and thence laterally out of the cord lock 30 along the interior of the channel 11, as at cord portion 34.

Figure 2:
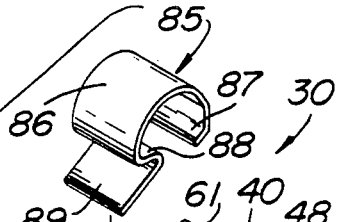
FIG. 2 is a top perspective view showing a cord lock of the present invention apart from the venetian blind and exploded to illustrate the component parts.
Figure 2:
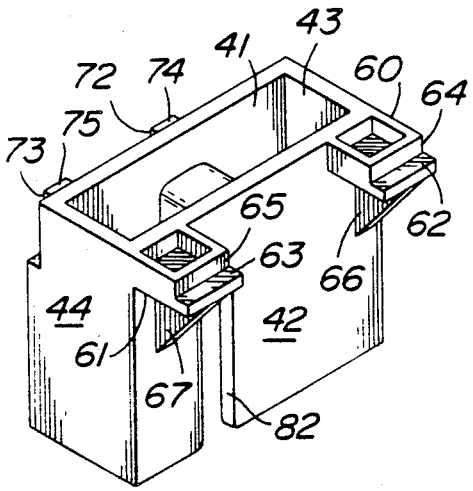
Figure 3:
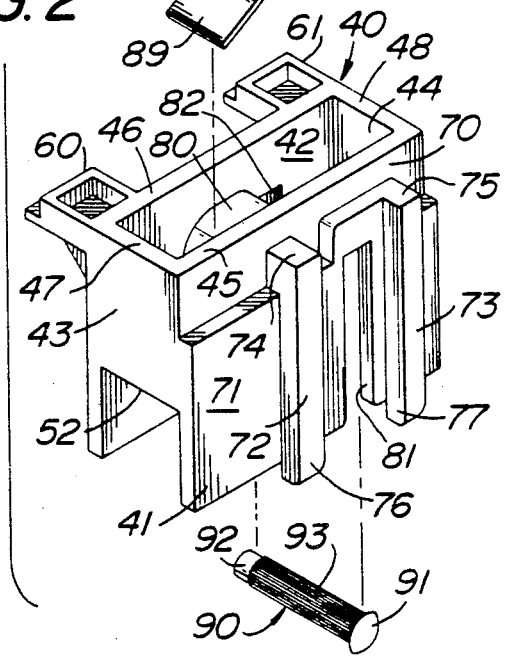
FIG. 3 is a top perspective view showing the primary component of the cord lock of FIGS. 1 and 2, but illustrating the opposite aspect thereof.

The cord lock 30, as in the exploded view of FIG. 2, includes a hollow structure, generally designated 40, admirably well suited for economic mass production as by injection molding, or other suitable manufacture. The hollow structure 40 is of generally rectangular overall configuration, including a generally rectangular front wall 41 and a generally rectangular back wall 42 in parallel spaced relation with the front wall. Extending between adjacent side edges of the front and back walls 41 and 42 are generally vertical side walls 43 and 44. The upper edges of the front and back walls 41 and 42 and side walls 43 and 44 terminate in coplanar or flush upper edges 45, 46, 47 and 48, respectively. The plane of the upper edges 45–48 is generally horizontal and normal to the walls 41–44. The lower edges of the walls 41, 42 and 44 are generally flush or coplanar, as at 49, 50 and 51, respectively, lying in a plane generally normal to the walls 41–44. The side wall 43 has its lower portion cut away, as at 52 to define an opening for passing the lift cord portion 34; and has its lower edge rounded, as at 53, best seen in FIG. 4, to minimize wear on the cord portion 34.

Projecting generally horizontally outwardly from the upper region of the back wall 42 are a pair of outstanding formations or lugs 60 and 61, both being generally flush with the upper wall edges 45–48, while the projection 60 is vertically flush with side wall 43 and the projection 61 is vertically flush with side wall 44. At their distal extremities the projections 60 and 61 are respectively provided with upwardly facing shoulders 62 and 63 which are recessed below the upper surfaces of the projections 60 and 61 and extend inwardly to meet respective vertical surfaces 64 and 65 extending upwardly to the upper surfaces of the projections 60 and 61. The upwardly facing shoulder 62 and 63 are generally coplanar with each other, spaced below the plane of edge surfaces 45–48; and the outwardly facing surfaces 64 and 65 are generally coplanar with each other in a plane generally parallel to and spaced from the plane of rear wall 42. Supporting struts or braces 66 and 67 may extend, respectively, from the undersides of projections 60 and 61 downwardly and forwardly to the rear wall 42.

The front wall 41 of hollow structure 40 has an upper region 70 spaced inwardly from a lower region 71. A pair of generally upright forwardly protruding formations or spacers 72 and 73 extend forwardly or outwardly from the front wall 41, from the lower edge 49 of the front wall up to and terminating short of the plane of upper edges 45–48. More specifically, the forward protusions 72 and 73 extend upwardly to terminate in respective upwardly facing shoulders 74 and 75, which shoulders are spaced apart from and generally coplanar with each other, being in the region of inset upper wall portion 70 and equally spaced below the plane of front wall upper edge 45.

In addition to protruding forwardly from the front wall 41 and extending generally vertically thereon spaced inwardly from respective adjacent side walls 43 and 44, the spacers 72 and 73 depend slightly below the front wall lower edge 49, as at 76 and 77, respectively. The depending portions or lugs 76 and 77 may have their forward surfaces curved, as seen in FIG. 5. Also best seen in FIG. 5 is that the forward, coplanar shoulders 74 and 75 may be substantially coplanar with the rearward or back shoulders 62 and 63.

Interiorly between the front, rear and side walls 41–44, the structure 40 is hollow, the space therein being bridged by a bridging member or guide 80 which may be formed integrally with and extends transversely between the front and back walls 41 and 42. The bridging member or guide 80, as seen in FIG. 4, may be of a generally arcuate or inverted U-shaped configuration in cross section, being adjacent to and spaced below the upper edge surfaces 45 and 46, while being considerably spaced from the side walls 43 and 44, and the lower edge surfaces 49 and 50.

Formed in the front and back walls 41 and 42, extending generally vertically therein, are respective slots 81 and 82. The slots 81 and 82 are in forward and rearward alignment with each other, respectively opening vertically upwardly through the lower edges 49 and 50 of front and back walls 41 and 52, and terminating short of the upper front and back wall edges 45 and 46. Further, the slots 81 and 82 extend vertically upwardly generally toward and just offset to one side of the guide member 80. The slots 81 and 82 may have their upper regions generally flush with one side of the guide member 80, as may be observed in FIG. 4. That is the slots 81 and 82 extend vertically in substantial parallelism with the side walls 43 and 44, having their upper regions contiguous to one side of the guide member 80, that side of the guide member 80 adjacent to the side wall 44.

In assembly with the channel 11, the hollow structure 40 may be snap engaged downwardly by slight spreading of the headrail side walls 16 and 17, to engage the depending lugs 76 and 77 in cut-out notches 26 and 27 while snapping the shoulders 74 and 75 beneath lip 18 and snapping shoulders 62 and 63 beneath lip 19. This condition is best seen in FIG. 5. As the protusions or spacers 72 and 73 are then in facing engagement with the front headrail wall 16 and the lip 19 is engagable with the vertical lug surfaces 64 and 65, it will be appreciated that the structure 40 is restrained against forward and rearward movement in the headrail. The engagement of lips 18 and 19 with shoulders 74, 75 and 62 and 63, as well as engagement of lower edge surfaces 49–51 with headrail bottom wall 15, restrain the structure 40 against vertical movement in the headrail. Further, the engagement of depending portions or lugs 76 and 77 in cut-out portions 26 and 27 restrains the structure 40 against lateral movement along the headrail, so that the hollow structure is effectively retained in the desired assembled position. If disassembly should be desired for any particular reason, the headrail back wall 17 may be deflected away from the headrail front wall 16 to release the shoulders 62 and 63 from lip 19 and permit removal of the hollow structure.

As the cord portion 33 of lift cord 31 extends over the guide member 80, and runs along the guide member during lifting and releasing operation, the guide member would be subject to considerable wear by the cord. To prevent guide member wear there is provided a collar, guard or shield 85, which may be a separate piece fashioned of smooth, resiliently deflectable sheet metal, including an arcuate main portion 86 of generally semicircular extent and having at opposite ends generally radially inturned flanges or lips 87 and 88. Extending from the inner end of one lip 88, may be a radially outstanding finger or extension 89. The collar or guard 85 is engaged in conformably covering relation over the inverted U-shaped guide 80, being resiliently distended for snap engagement about the latter and thereby retained in this protective relationship. Should removal be desired for any reason, the finger 89 may be employed to reverse the above procedure and remove the collar 85.

As best seen in FIG. 4, the cord portion 33 is trained over and substantially about the guide collar 85, and thence through the opening 52 beneath rounded edge 53 of wall 43.

In addition, a jamming member or pin 90 extends loosely through both slots 81 and 82, and has its opposite ends extending beyond respective front and back walls 41 and 42. Specifically, one end of jamming member or pin 90 may be enlarged or headed, as at 91, and the other end may be smooth, as at 92. Intermediate the head 91 and smooth region 92, the pin may be roughened, knurled, or grooved, as at 93 to provide a frictional surface. In the assembled relation, the head 91 is captured in the space defined between the front wall 41 of hollow structure 40 and front wall 16 of channel 11, so that the pin cannot escape from the slots 81 and 82. However, the pin is freely movable along the slots 81 and 82, in the vertical direction therealong, so that the slots define ways or way means guiding the pin vertically generally toward and away from the guide 80. For purposes of operation, the wear collar 85 may be considered as part of the guide 80, and in the jammed condition shown in FIGS. 4 and 5, it will be seen that the cord portion extends upwardly between the elevated jam member 90 and the guide 80 for retention therebetween. That is, the weight of the slats 12 tends to exert tension on the lift cord 31 in the leftward direction over the guide 80 as seen in FIG. 4. By frictional engagement of the cord with the jamming member 90, the latter is raised in the slots 81 and 82 to a limiting position in jamming engagement against the cord and jamming the cord between the pin and the guide member, as shown in FIG. 4. Upon slight downward pull of the lift cord 31 at the front region 32, and leftward swinging of the cord region 32, the jamming member 90 will be released to fall gravitationally and the lift cord 31 will be free to move in either desired direction. Slight rightward swinging of the lift cord portion 32 to engage the jamming member 90 and raise the same will return the jamming member to the illustrated jamming condition of FIGS. 4 and 5.

From the foregoing it is seen that the present invention provides a cord lock for a venetian blind which fully accomplishes its intended objects and is otherwise well adapted to the practical conditions of manufacture and use.

Although the present invention has been described in some detail by way of illustration and example for purposes of clarity of understanding, it is understood that certain changes and modifications may be made within the spirit of the invention.

What is claimed is:

1. In a venetian blind, the combination comprising a headrail channel having a bottom wall with a cut-out, front and back walls upstanding from said bottom wall, and inturned upper lips on said front and back walls and terminating in downwardly facing edges; and, a cord lock structure integrally fabricated of plastic and comprising a pair of generally vertical front and back structure walls having lowered edges seated on said channel bottom wall and a pair of spaced generally vertical side structure walls extending between said front and back structure walls and combining therewith to define an opening between said front, back and side structure walls communicating downwardly through said cut-out, upwardly facing front and back shoulders externally on said front and back structure walls beneath and in retaining engagement with the respective inturned lip edges of said front and back channel walls to retain said structure downwardly on said channel bottom wall, said front and back shoulders respectively terminating inwardly in forwardly and rearwardly facing wall portions upstanding above said shoulders between and for engagement with said front and back wall lips to restrain forward and backward movement of said structure in said channel, a fixed guide member extending generally horizontally forwardly and rearwardly between said front and back structure walls and spaced over said opening for guiding a lift cord upwardly through said opening and laterally outwardly from said structure, generally upright slots in said front and back structure walls extending downwardly generally from the elevation of said guide member and defining way means, and a jamming element shiftable up and down in said way means toward and away from cord jamming relation with said guide member, said jamming element having a frictional surface for frictional engagement with a lift cord and elevation thereby into said jamming engagement.

2. The combination according to claim 1, in combination with formations depending from said structure for engagement through said cut-out to limit lateral movement of said structure in said channel.

3. The combination according to claim 1, said structure front and back walls being respectively located adjacent to and spaced from said channel front and back walls, and said side walls extending forwardly and rearwardly between said structure front and back walls.

4. The combination according to claim 3, in combination with spacer means on said front structure wall to maintain spacing from the adjacent front channel wall, and said jamming element comprising a headed pin freely shiftable in said slots and having its head retained in the space between said said front structure wall and the adjacent channel wall.

5. The combination according to claim 4, said guide member being of noncircular cross-section, and a wear collar nonrotatably engaged about said guide member to resist wear by a lift cord.

6. The combination according to claim 1, said front, back and side walls being generally vertically disposed for square seating on the channel bottom wall.

* * * * *